US009602909B2

(12) United States Patent
Asrani et al.

(10) Patent No.: US 9,602,909 B2
(45) Date of Patent: Mar. 21, 2017

(54) WIRELESS COMMUNICATION EARPIECE

(71) Applicant: Google Technology Holdings LLC, Mountain View, CA (US)

(72) Inventors: Vijay L. Asrani, Round Lake, IL (US); Peter Nanni, Algonquin, IL (US)

(73) Assignee: Google Technology Holdings LLC, Mountain View, CA (US)

( * ) Notice: Subject to any disclaimer, the term of this patent is extended or adjusted under 35 U.S.C. 154(b) by 501 days.

(21) Appl. No.: 13/942,730

(22) Filed: Jul. 16, 2013

(65) Prior Publication Data

US 2014/0376735 A1 Dec. 25, 2014

Related U.S. Application Data

(60) Provisional application No. 61/837,240, filed on Jun. 20, 2013.

(51) Int. Cl.
*H04R 1/10* (2006.01)

(52) U.S. Cl.
CPC ..... *H04R 1/1041* (2013.01); *H04R 2420/07* (2013.01)

(58) Field of Classification Search
CPC ..... H04R 1/10; H04R 1/1041; H04R 1/1091; H04R 1/1016; H04R 2420/07; H04R 2460/03; H04R 25/40; H04R 25/453; H04R 25/70; H04R 25/305; H04R 25/554; H04R 25/552; H04R 25/558; H04R 25/2407; H04R 2225/41; H04R 2225/61; H04R 2225/83; H04R 2201/107; H04R 2201/109; H04R 2460/00; H04R 2225/81; H04R 2225/77; H04R 2225/67; H04R 2225/63;

(Continued)

(56) References Cited

U.S. PATENT DOCUMENTS 5,446,788 A 8/1995 Lucey et al.
5,466,020 A 11/1995 Page et al.
(Continued)

FOREIGN PATENT DOCUMENTS

WO 2012030461 A1 3/2012
WO 2012106547 A1 8/2012

OTHER PUBLICATIONS

"Restriction Requirement", U.S. Appl. No. 13/947,590 Sep. 1, 2015, 7 pages.

(Continued)

*Primary Examiner* — Leshui Zhang
(74) *Attorney, Agent, or Firm* — Wolfe-SBMC

(57) ABSTRACT

A method and apparatus for a wireless communication earpiece. The wireless communication earpiece comprises an earbud and an electronics portion. A manual selection of one of a left ear and a right ear position of the earbud is conveyed to the electronics portion by one of an electrical and mechanical means. In some embodiments, a right antenna element is electrically coupled (activated) to a transceiver when the right ear position is selected and a left antenna element is activated when the left ear position is selected. In some embodiments, an antenna element is coupled to the transceiver and the antenna element is rotated to a right side (activated) of the earpiece when the right ear position is selected and the antenna element is rotated to a left side (activated) of the earpiece when the left ear position is selected.

18 Claims, 5 Drawing Sheets

(58) Field of Classification Search

CPC ..... H04R 2225/59; H04R 2225/53; H04R 2225/51; H04R 2225/49; H04R 2225/43; H04R 2225/33; H04R 2225/31; H04R 2225/025; H04R 2225/023; H04R 2225/021; H04B 5/00; H04B 7/0834; G06F 3/013; G08B 23/00; H04M 1/00; H04M 1/05; H04M 1/1066; H04M 1/08; H04M 1/0258; H04M 1/0281; H04M 1/6058; H04M 1/1025; H04M 1/1075; H04M 1/105; H04M 1/1058; H04W 92/18; H01Q 1/273; H01Q 1/44; H01Q 21/28; H01Q 25/00; H01Q 9/14

USPC ..... 381/74, 312–331, 23.1, 60, 72, 75, 76; 343/751, 876, 745; 455/569.1, 569.2, 455/570, 45.1; 700/94

See application file for complete search history.

(56) References Cited

U.S. PATENT DOCUMENTS

| | | | |
|---|---|---|---|
| 5,960,094 | A | 9/1999 | Jensen et al. |
| 6,233,344 | B1 | 5/2001 | Clegg et al. |
| 6,377,697 | B1 | 4/2002 | Cheng |
| 7,609,845 | B2 | 10/2009 | Chang |
| 7,613,292 | B2 | 11/2009 | Te Riet |
| 7,664,287 | B2 | 2/2010 | Neu et al. |
| 7,925,037 | B2 | 4/2011 | Te Riet |
| 8,217,843 | B2 | 7/2012 | Shtrom et al. |
| 8,411,893 | B2 | 4/2013 | Ito et al. |
| 8,611,582 | B2 | 12/2013 | Lee |
| 9,521,478 | B2 | 12/2016 | Jiang et al. |
| 2002/0041697 | A1 | 4/2002 | MacDonald et al. |
| 2002/0080989 | A1 | 6/2002 | Chi-Lin |
| 2002/0106100 | A1 | 8/2002 | Kao |
| 2004/0190745 | A1 | 9/2004 | Chen |
| 2005/0058280 | A1 | 3/2005 | Ma |
| 2005/0078847 | A1 | 4/2005 | Dobras et al. |
| 2006/0099993 | A1 | 5/2006 | Leinonen et al. |
| 2006/0291686 | A1 | 12/2006 | HLas et al. |
| 2007/0003095 | A1 | 1/2007 | Slamka et al. |
| 2007/0165875 | A1* | 7/2007 | Rezvani ..... H04M 1/6066 381/74 |
| 2007/0223765 | A1 | 9/2007 | Wang |
| 2007/0286409 | A1 | 12/2007 | Liu et al. |
| 2008/0051166 | A1* | 2/2008 | Kang ..... H04R 1/1091 455/575.7 |
| 2008/0188179 | A1 | 8/2008 | Liu et al. |
| 2009/0097690 | A1 | 4/2009 | Liu et al. |
| 2009/0134306 | A1 | 5/2009 | Koo |
| 2011/0268304 | A1 | 11/2011 | Ang et al. |
| 2012/0052924 | A1* | 3/2012 | Cybart ..... H04M 1/05 455/569.1 |
| 2013/0182867 | A1* | 7/2013 | Knowles ..... H04B 7/0834 381/74 |
| 2013/0343595 | A1 | 12/2013 | Zorkendorfer et al. |
| 2015/0013112 | A1 | 1/2015 | Jiang et al. |

OTHER PUBLICATIONS

"Non-Final Office Action", U.S. Appl. No. 13/947,590, Mar. 21, 2016, 10 pages.

"Corrected Notice of Allowance", U.S. Appl. No. 13/947,590, Oct. 3, 2016, 2 pages.

"Notice of Allowance", U.S. Appl. No. 13/947,590, Aug. 3, 2016, 5 pages.

* cited by examiner

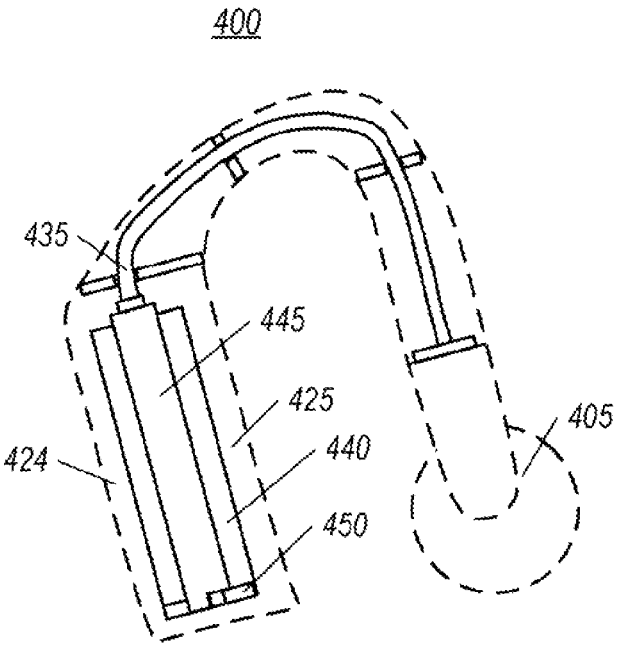
FIG. 9
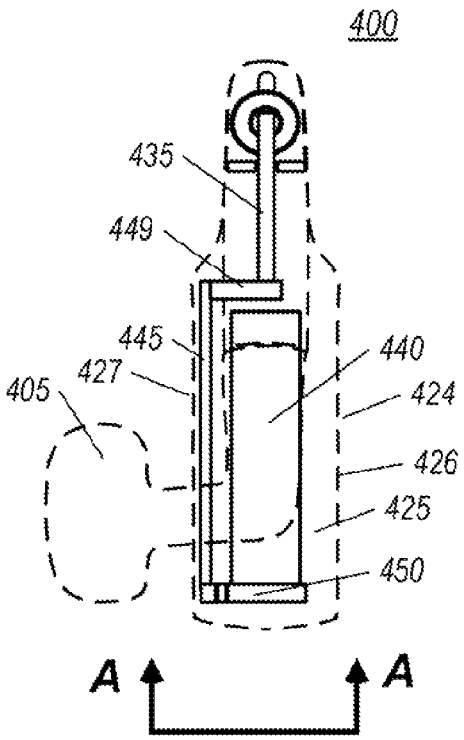
FIG. 10
FIG. 11
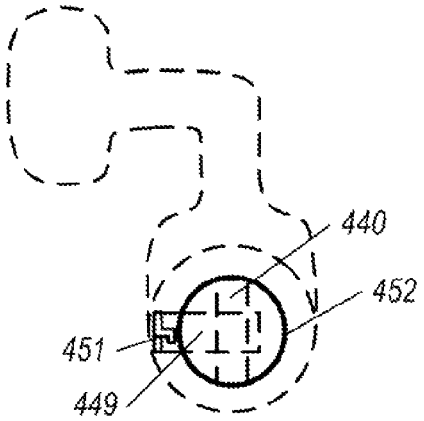
VIEW A -A-

WIRELESS COMMUNICATION EARPIECE

FIELD OF THE INVENTION

The present invention relates generally to wireless communication devices, and more specifically to wireless communication earpieces that are adaptable to a left or right ear.

BACKGROUND

Wireless communication earpieces are well known. Many such devices are designed to couple to a wide area portable communication device, such as a cell phone, by Bluetooth® (a trademark registered to Bluetooth SIG, Inc., Kirkland, Wash., USA). The use of Bluetooth allows the electronics in the earpiece to be quite small and yet audibly robust, and provides both close range audible reception (via an earbud speaker) and transmission (using one or more microphones). Some wireless communication earpieces are available with a mechanically selectable right ear or left ear position.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments that include the claimed invention, and explain various principles and advantages of those embodiments.

FIGS. 9-11 are outline drawings of a fourth earpiece.

DETAILED DESCRIPTION

Figure 1:
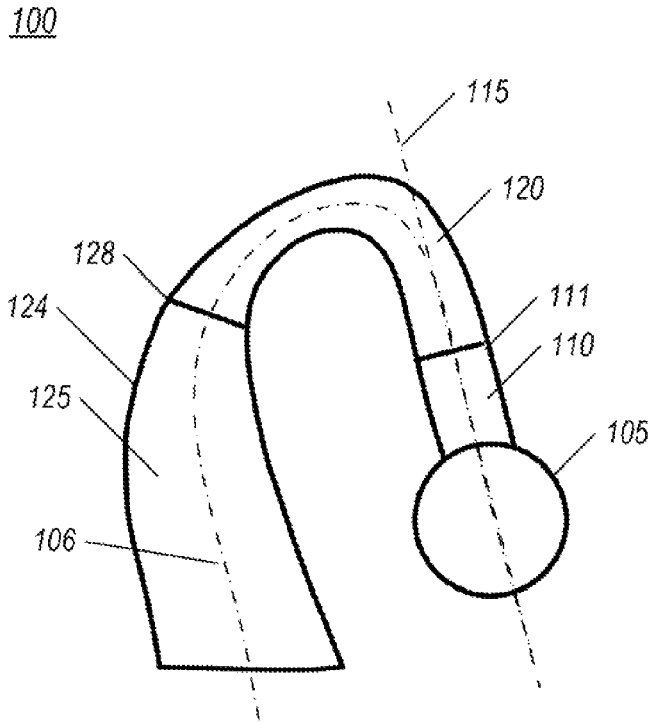
FIGS. 1-3, are outline diagrams of a first wireless communication earpiece.

Before describing in detail the following embodiments, it should be observed that the embodiments reside primarily in combinations of method steps and apparatus components related to optimizing antenna efficiency in a wireless communication earpiece. This is accomplished by activating an antenna element that is on the side of the wireless communication earpiece that is farther from the head of the user. As is well known, the efficiency of an antenna for the radio protocols most commonly used in wireless communication earpieces is higher when the antenna of the wireless communication earpiece is not close to the head. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

Figure 2:
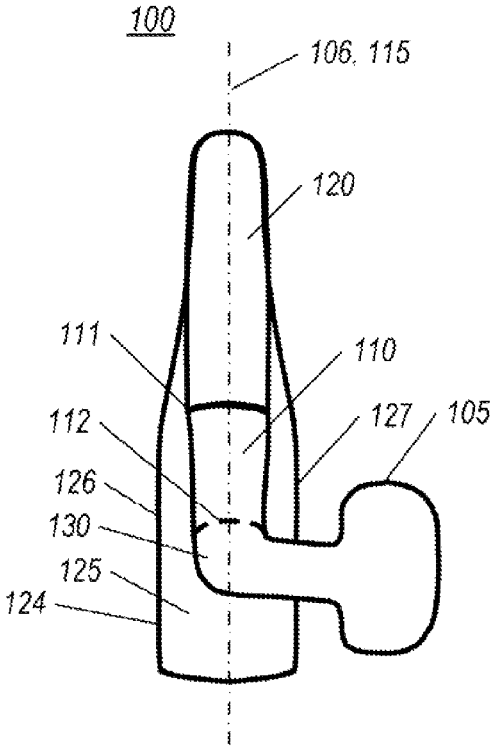
Figure 3:
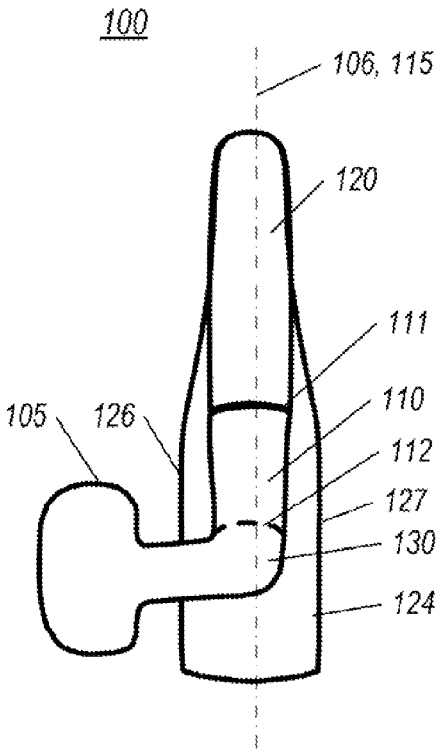

Referring to FIGS. 1-3, outline diagrams of a wireless communication earpiece 100 are shown, in accordance with certain embodiments. "Wireless communication earpieces" will be more simply referred to hereafter as earpieces. The earpiece is shown in FIG. 1 from the right side (head side) of the earpiece 100 when it is configured for use on the left ear. FIG. 2 shows the earpiece 100 from the front when it is configured for the right ear position. FIG. 3 shows the earpiece 100 from the front when it is configured for the left ear position. The earpiece 100 comprises an earbud 105. For the purposes of this document the earbud 105 is a portion of the earpiece 100 that is designed so that it can be rotationally positioned to direct audio from the earpiece 100 into the ear canal for either a right ear or a left ear. In accordance with certain embodiments, the earbud 105 of earpiece 100 is fixedly mounted to a portion of the earpiece 100 herein identified as a boom 110. The boom 110 is rotatably coupled to the remainder of the earpiece 100 at a first rotational coupling 111 and can be manually rotated around an axis 115 of the first rotational coupling 111 to at least two positions that are approximately 180 degrees apart. The earbud 105 is projected from the boom 105 from the boom at approximately 90 degrees with reference to the axis of rotation 115 The two earbud positions are the positions illustrated in FIGS. 2 and 3, and are named the right ear position (FIG. 2) and the left ear position (FIG. 3). "Approximately 180 degrees" means up to 220 degrees in some embodiments. In certain embodiments the first rotational coupling 111 may be described as being at a front end of a crossover portion 120 of the earpiece 100. The right and left ear positions of the earbud 105 may be described as approximately plus and minus 90 degrees of the earbud projection with reference to a plane of the longitudinal axis 106 of the earpiece 100. For earpieces that differ from the one illustrated in FIGS. 1-3, in which the longitudinal axis does not lie in a plane, the plane of the longitudinal axis refers to a plane from which the longitudinal axis has a minimum deviation as determined by a mathematical least square method. Approximately 90 degrees means between 75 and 105 degrees.

Another portion of the earpiece 100 is the electronics portion 125. The electronics portion 125 comprises at least a housing 124 and an antenna (not shown in FIGS. 1-3), and may further comprise a battery, a transceiver, and a circuit module. The housing 124 of the electronics portion 125 has a right side 126 and a left side 127. In some embodiments, the electronics portion 125 is rotatably coupled to the crossover portion 120 at a second rotational coupling 128, which, for example, may allow comfortable adjustment of the electronics portion behind the ear. The second rotational coupling 128 may be located substantially farther or closer to the ear bud along a longitudinal axis 106 of the earpiece 100 than shown in FIG. 1. In some embodiments, the electronics portion 125 and the crossover portion 120 are not rotatably coupled, and may use contiguous housing pieces. In some embodiments, the first rotational coupling 111 may be located higher or lower than illustrated in FIG. 1. In certain embodiments, there may be no boom 110; the earbud in these embodiments may be rotatably coupled directly to the front end of a crossover piece as shown by dotted rotatable coupling 112 in FIGS. 2-3. In these embodiments, the front end of the crossover piece 120 is located at the coupling of the earbud 105 and the crossover piece 110, and the crossover piece in one example may be approximately as long as the crossover piece 120 and the boom 110 of FIG. 1. The earbud may more generally be described as being rotationally coupled to the earpiece 200 and projecting from a low front end 130 of the earpiece 100. The earbud projects from the low front end 130 of the earpiece 100 at an angle of approximately 90 degrees with reference to the longitudinal axis 106 of the earpiece 100 at the rotational coupling 111. In some embodiments, approximately 90 degrees means between 75 degrees and 105 degrees. In some embodiments, the earbud 105 may have one or both of a third and fourth rotational position. These positions are between the left ear position and the right ear position. In the third position the earbud 105 is pointed towards the electronics portion 125 of the earpiece 100. In the fourth position the earbud 105 is pointed away from the electronics portion 125 of the earpiece 100. These position may be used as off positions, in which case the off position is electrically sensed and used to power down the earpiece 100. Audio coupled by the earbud 105 to the ear is typically generated by a speaker within the earbud. In certain embodiments, the audio may be generated by a speaker within the electronics portion 125 and acoustically coupled through the crossover portion 120 and the boom 110 to the earbud 105

Figure 4:
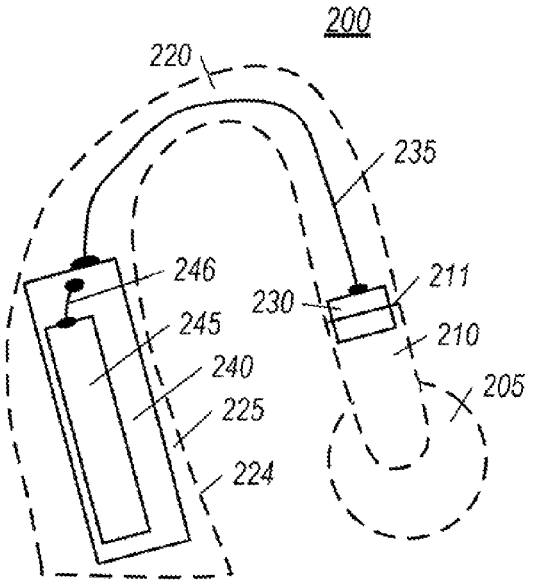
FIGS. 4-5 are outline drawings of a second wireless communication earpiece.
Figure 5:
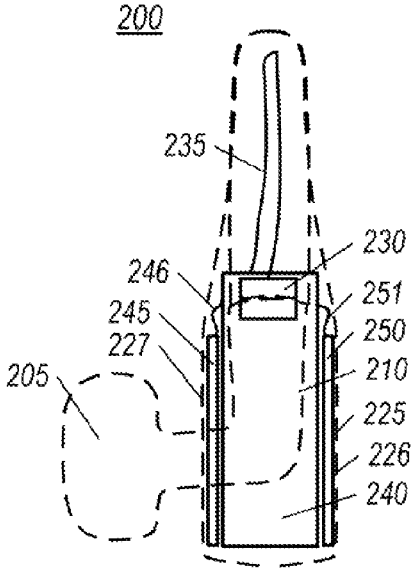

Referring to FIGS. 4-5, outline drawings of an earpiece 200 are shown, in accordance with certain embodiments. The earpiece 200 is shown in FIG. 4 from the right side (towards head) of the earpiece 200 when it is configured for use on the right ear. FIG. 5 shows the earpiece 200 from the back when it is configured for the right ear position. The earpiece 200 has many of the same exterior aspects of the earpiece 100. The outlines of an earbud 205, a boom 210, a crossover portion 220, and electronics portion 225 are shown in dotted lines. Also shown are a right 226 and a left side 227 of the electronics portion 225. Interior parts are represented by solid lines. In these embodiments a second rotational coupling between the housing of the electronics portion 225 and the crossover portion 220 is not needed; these housings may be fixedly coupled or may be one piece as assembled. There is a first rotational coupling 211 between the boom 210 and the crossover piece 220. At the location of the first rotational coupling 211 there is a rotational position sensor 230 that detects at least two positions of the earbud rotation; these two positions are approximately 180 degrees apart, as described above with reference to FIGS. 1-3, and correspond to the left and right ear positions. The rotational position sensor 230 may be coupled by a signal cable 235 that passes through the crossover portion 220 to an electronics module 240 located in the electronics portion 225. Although the illustration shows a cylindrical form factor for the electronics module 240, the form factor may be another variety, such as a printed circuit board form factor. The signal cable 235 electronically conveys information to the electronics module 240 that indicates (at a minimum) when the earbud 205 is in one of the left and right ear positions of the earbud 205. The electronics module 240 is further coupled to two antenna elements: right antenna element 245 and left antenna element 250. In response to detecting that the earbud 205 is in one of the right and left ear positions, the electronics module 240 performs a single pole double throw switching function that couples a transceiver (not shown in FIGS. 4-5) to the one of the right and left ear antennas 245, 250 that corresponds, respectively, to the right and left ear positions. The transceiver is part of the electronics module 240. The right antenna element 245 and the left antenna element 250 are shown in FIGS. 4-5 as being connected to the electronics module 240 by wires 246, 251. The right and left antenna elements 245, 250 are located proximate, respectively, the right and left sides 226, 227 of the electronics portion 225. Proximate in these embodiments means either close to but separated from an inside of a housing of the electronics portion 225, or disposed on a surface or in a wall of the housing of the electronics portion 240.

It will be appreciated that when the earbud 205 is in the right ear position and being normally worn on a user's head, the right antenna element 245 is on an outer side of the earpiece 200 with reference to the head. (The outer side in this instance is the right side 226). Conversely, when the earbud 205 is in the left ear position and being normally worn on a user's head, the left antenna element 250 is on an outer side of the earpiece 200 with reference to the head. (The outer side in this instance is the left side 227). These arrangements can alternatively be described as ones in which the right antenna element 245 is on the outer side of the earpiece 200 and electrically selected when the earbud 205 is in the right ear position, and the left antenna element 250 is on the outer side of the earpiece 200 and electrically selected when the earbud 205 is in the left ear position. For example, the antenna elements 245, 250 may be fixedly mounted to the electronics module 240 and separated from an inside surface of a wall of the housing 224 of the electronics portion 225. In another example, the right and left antenna elements 245, 250 could be disposed on the inside surface or the outside surface or the interior of the wall of the housing 224 of the electronics portion 225. Coupling the antenna elements 245, 250 to the electronics module 240 could be accomplished as described with reference to FIGS. 4-5 (using a wire for each), or by other means. As one example, the antenna elements 245, 250 could comprise sheet metal parts that are formed with solder tabs that are soldered to the electronics module 240.

Although the signal cable 235 is described as being coupled to the rotational position sensor 230 located at the first rotational coupling 211 shown in FIGS. 4-5, it will be appreciated that the electrical sensing of the left and right ear positions could be accomplished in other ways. As just one example, a conductive tab on an ring fixedly coupled to the crossover portion 220 of the earpiece 200 but down within the boom 210 beneath the first rotational coupling 211 could sweep the inside surface of the housing of boom 210 and be grounded at the two positions by conductive material disposed on the inside surface of the boom 210 at the two positions. The signal cable 235 conveys at least right and left ear position indications. In some embodiments, the signal cable may comprise one wire for each position and a common ground between the position sensing device (e.g., rotational position sensor 230) and the electronics module 240. The signal cable 235 may further include wires for an OFF position indicator and may include speaker wires that are terminated at a speaker in the earbud 205. The signal cable may have as few as one wire. As one example, one wire may suffice in embodiments in which the common ground is carried by a conductive coating of a housing of the earpiece and the rotational position is indicated as two positions, each of which has a range that spans one half (approximately 90 degrees) of the total range of rotational position. In this example, an OFF indication may be provided by a button on the housing 224 of the electronics portion 225.

Figure 6:
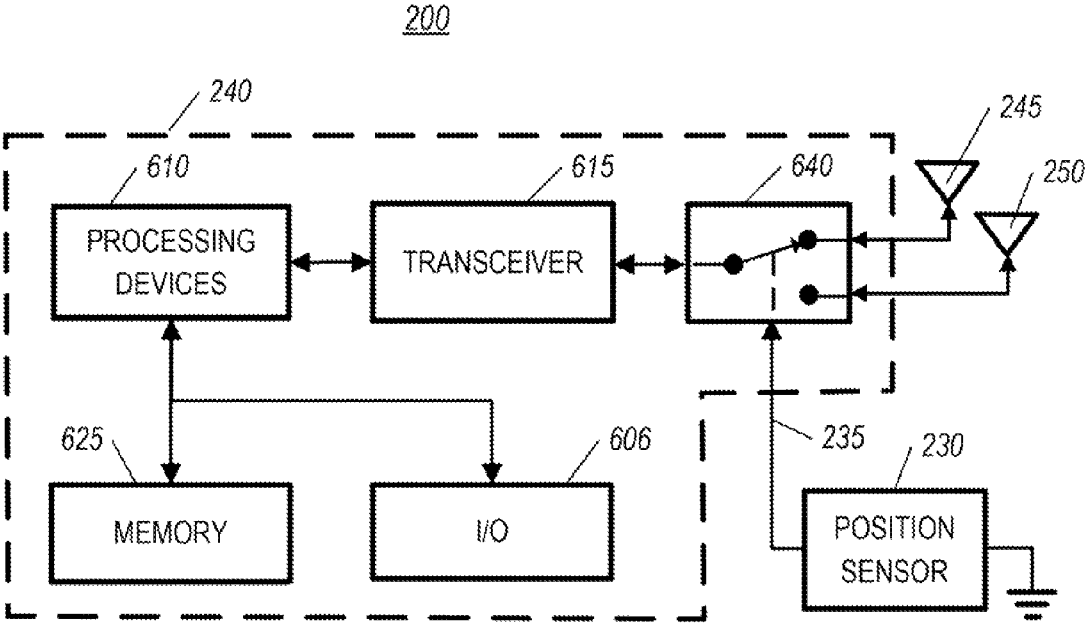
FIG. 6 is an electronic block diagram of the second earpiece.

Referring to FIG. 6, an electronic block diagram of the earpiece 200 is shown, in accordance with certain embodiments. The earpiece 200, illustrated as an electronic block diagram, comprises the electronics module 240, a right antenna element 245, a left antenna element 250, and a rotational position sensor 230. The electronics module 240 comprises one or more processors 610, each of which may include such sub-functions as central processing units, cache memory, instruction decoders, just to name a few. The processors execute program instructions which could be located within the processors in the form of programmable read only memory, or may be located in a memory 625 to which the processors 610 are bi-directionally coupled. The processors 610 may include input/output interface circuitry and/or may be coupled to separate input/output interface circuitry 606. The input/output interface circuitry may interface to devices such as buttons, a speaker output, microphone inputs, and LED indicators. The processors 610 are further coupled to a radio transceiver 615. The radio transceiver 615 is a radio receive-transmit function. The radio transceiver 615 is bi-directionally coupled to at least one of the two antenna elements 245, 250 at any given time by electronic switch 640.

In some embodiments, the transceiver 615 is a MIMO (multiple input multiple output) antenna capable transceiver. In these embodiments the electrical block diagram may be modified to have no electronic switch 640; each antenna element 245, 250 may be directly coupled (or could be switchably coupled) to the transceiver 615. The output 235 of the position sensor in these embodiments may be coupled to the I/O function 606, which couples the sensor information to the MIMO antenna capable transceiver 615 (these changes are not explicitly shown in FIG. 6). The earpiece 200 may then employ the MIMO transceiver when in at least one of the right and left ear positions and use the antennas 245, 250 in a MIMO configuration to optimize the efficiency of both transmission and reception.

In some embodiments, the transceiver 615 is capable of diversity reception. In these embodiments the electrical block diagram may be modified to have no electronic switch 640; each antenna element 245, 250 may be directly coupled to the transceiver 615. The antenna element 245 or 250 that is at the outer side of the earpiece 200 may be used as a primary transmit and receive antenna element, while the other antenna element 250 or 245 may be used as a secondary receive antenna element.

In some embodiments, the processors 610 may be coupled to the transceiver function 615 through serial signal lines via the input/output function 606 instead of by a direct parallel data connection. The transceiver function 615 may itself comprise one or more processors and memory, in addition to circuits that are unique to radio functionality. In some embodiments, the electronics portion 240 provides Bluetooth communications to another Bluetooth capable device. In some embodiments, the rotational position sensor 230 is an electromechanical position sensor that is coupled to the electronics portion 240 of the earpiece 200 by electrical cable 235. The signals coupled to the electronics portion 240 indicate when the earbud is in one of the right and left ear positions. Some of the embodiments described with reference to FIGS. 4-6 may be described as an apparatus comprising an earbud 205 and an electronics portion 225. The earbud is rotatably coupled to the earpiece 200 and projects from a low front end 130 of the earpiece 200, wherein the earbud 205 has at least two manually selectable rotational positions, namely a right ear position and a left ear position. The electronics portion 225 of the earpiece comprises a housing 224, a transceiver 615, a right antenna element 245 disposed proximate a right side 226 of the housing, and a left antenna 250 element disposed proximate a left side 227 of the housing, wherein, in response to a manual selection of the right ear position, the right antenna element 245 is selectively coupled to the transceiver 615, and in response to a manual selection of the left ear position, the left antenna element 250 is selectively coupled to the transceiver 615.

Figure 7:
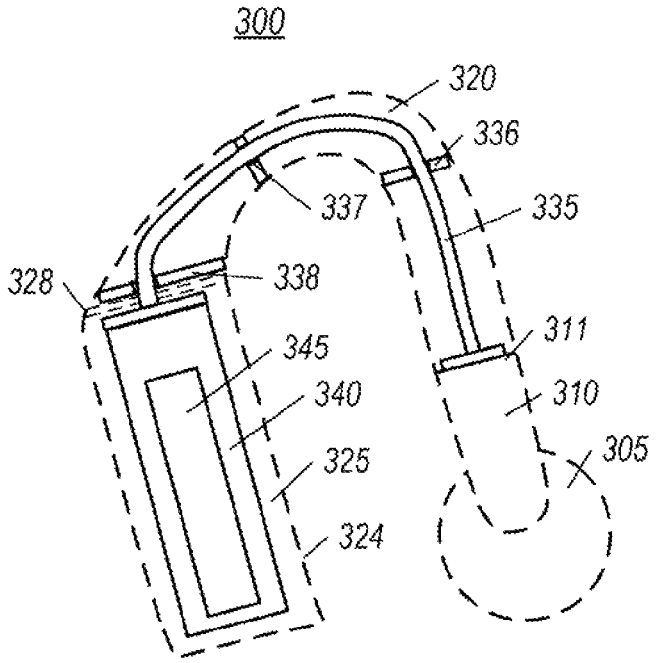
FIGS. 7-8 are outline drawings of a third earpiece.
Figure 8:
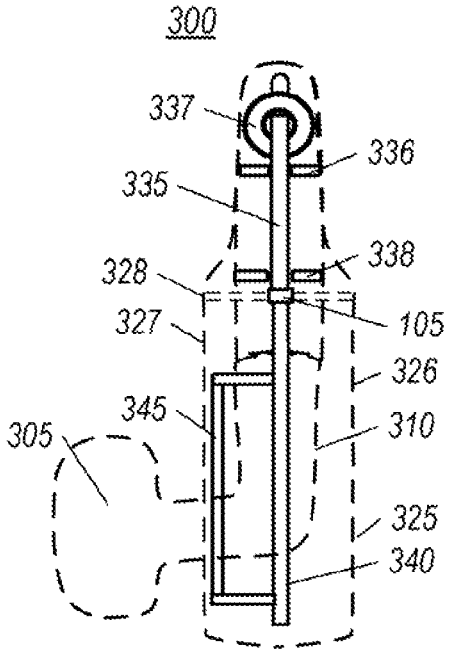

Referring to FIGS. 7-8, outline drawings of an earpiece 300 are shown, in accordance with certain embodiments. The earpiece 300 is shown in FIG. 7 from the right side (towards head) of the earpiece 300 when it is configured for use on the right ear. FIG. 8 shows the earpiece 300 from the back when it is configured for the right ear position. The earpiece 300 has many of the same exterior aspects of the earpiece 100. The outlines of an earbud 305, a boom 310, a crossover portion 320, and electronics portion 325 are shown in dotted lines. Also shown are a right 326 and a left side 327 of the electronics portion 325. Interior parts are represented by solid lines. In some of these embodiments mechanical rotational coupling between the housing of the crossover portion 320 and the housing of the electronics portion 325 is needed. There is a first rotational coupling 311 between the boom 310 and the crossover piece 320. At the location of the first rotational coupling 311 there is a mechanical coupling of the rotational position of the earbud 305 from the earbud 305 to the electronics portion 325 that transfers at least two positions of the earbud rotation; these two positions are approximately 180 degrees apart, as described above with reference to FIGS. 1-3, and correspond to the left and right ear positions. The mechanical coupling may be accomplished by a flexible coupling rod 335 that passes through the crossover portion 320 to the electronics portion 325. The flexible coupling rod 335 has the characteristics of being highly flexible along its longitudinal axis and torsionally inflexible. The rotational position of the flexible coupling rod 335 indicates (at a minimum) when the earbud 305 is in one of the left and right ear positions of the earbud 305. The flexible coupling rod 335 passes through several disk shaped guides 336, 337, 338. In some embodiments, the flexible coupling rod 335 is a combination of rigid rods coupled together by springs at high bend locations. In other embodiments, the overall shape of the earpiece 305 in the view shown in FIG. 7 is much more rectangular mechanical and coupling is provided by two rigid rods; each having a pulley at their top end. A first rigid rod is coupled to the earbud rotation and a second rigid rod is coupled to the electronics portion 325. The pulleys are coupled with a flexible band. Other means of mechanically coupling the earbud 305 to the electronics portion 325 could be used, such as rods with gears.

The electronics portion 325 comprises a housing 324, an electronics module 340, a transceiver (not shown in FIGS. 7-8) that is a part of the electronics module 340, and one antenna element 345 that is rotated in response to the position coupled from the earbud by the flexible coupling rod 335 or by alternative mechanical coupling arrangements as described above. The one antenna element 345 is typically coupled to the transceiver at all times. In some embodiments, the antenna element is disposed on or in the housing 324 of the electronics portion 325. In these embodiments, there is a second rotational coupling 328 of the housing 324 of the electronics portion 340 and the crossover portion 320. The position of the earbud 305 may be coupled in a one-to-one positional manner such that when the ear bud 305 is in the right ear position, the antenna element 345 is at the right side of the housing 324 and when the ear bud is in the right ear position, the antenna element 345 is at the right side of the housing 324.

It will be appreciated that when the earbud 305 is in the right ear position and being normally worn on a user's head, the antenna element 345 is on an outer side of the earpiece 300 with reference to the head. (The outer side in this instance is the right side 326). Conversely, when the earbud 305 is in the left ear position and being normally worn on a user's head, the antenna element 345 is on an outer side of the earpiece 200 with reference to the head. (The outer side in this instance is the left side 327). These arrangements can alternatively be described as ones in which the antenna element 345 is on an outer side of the earpiece 300 and electrically selected when the earbud 205 is in the right ear position, and the antenna element 345 is on the outer side of the earpiece 300 and electrically selected when the earbud 305 is in the left ear position.

Although the illustration shows a printed circuit board form factor for the electronics module 440, the form factor may be another variety, such as a cylindrical form factor. Proximate in these embodiments means either close to but separated from an inside surface of the housing of the electronics portion 325, or disposed on a surface or in a wall of the housing of the electronics portion 240.

Referring to FIGS. 9-11, outline drawings of an earpiece 400 are shown, in accordance with certain embodiments. The earpiece 400 is very similar to the earpiece 300 described with reference to FIGS. 7-8 in that a mechanical rod or alternative mechanical coupling is used between the earbud 405 and the electronics portion 425. In FIGS. 7-9, the electronics module 340 and the antenna element 345 are fixedly coupled to each other, such as by solder, and are both rotated by the mechanical position coupling. In contrast, in the embodiments illustrated by FIGS. 9-11, the antenna element 445 is rotated in response to the mechanical position coupling and the electronics module 440 is not rotated. In these embodiments, a rotational electrical coupling 450 may be used to couple the antenna element 445 to the electronics module 440, and ultimately, to the transceiver. FIG. 9 is a view of the earpiece 400 from the right side (towards head) when the earbud 405 is in the right ear position. FIG. 10 is a view of the earpiece 400 from the back when the earbud 405 is in the right ear position. FIG. 11 is a view from the bottom of the earpiece 400 shown in FIG. 10 that clarifies a tab 451 of the antenna element 445 riding on an electrical coupling ring 452. The electrical coupling ring is coupled to the electronics module 440. An upper end 449 of the antenna element 445 is connected to the mechanical coupling rod 435. The upper end 449 may be made of non conductive material such as plastic and be coupled to the antenna element 445.

It will be appreciated that when the earbud 405 is in the right ear position and being normally worn on a user's head, the antenna element 445 is on an outer side of the earpiece 400 with reference to the head. (The outer side in this instance is the right side 426). Conversely, when the earbud 405 is in the left ear position and being normally worn on a user's head, the antenna element 445 is on an outer side of the earpiece 400 with reference to the head. (The outer side in this instance is the left side 426). These arrangements can alternatively be described as ones in which the antenna element 445 is on the outer side of the earpiece 400 and electrically selected when the earbud 405 is in the right ear position, and the antenna element 445 is on the outer side of the earpiece 400 and electrically selected when the earbud 405 is in the left ear position.

Figure 12:
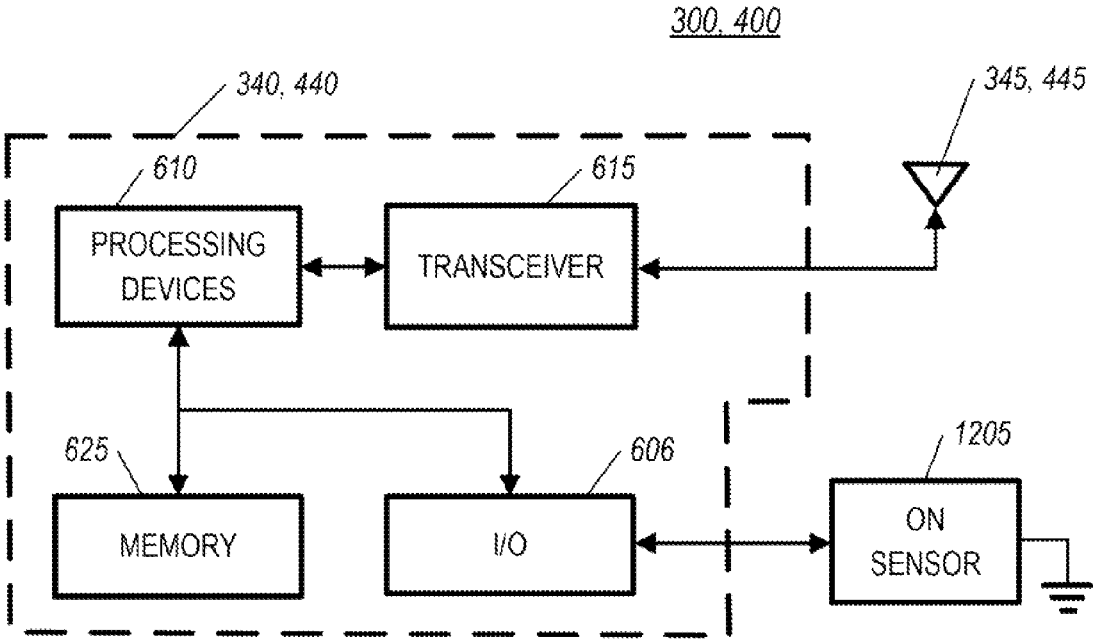
FIG. 12, an electronic block diagram of the earpiece 300 and 400 is shown, in accordance with certain embodiments.

Referring to FIG. 12, an electronic block diagram of the earpiece 300 and 400 is shown, in accordance with certain embodiments. The processing devices 610, the transceiver 615, the memory 625, and the I/O 606 are as described above with reference to FIG. 6. Because there is only one antenna element 345 or 445, the antenna element 345 or 445 is directly electronically coupled to the transceiver (either fixedly or by rotational coupling). There is no electrical connection to a position sensor for the purpose of identifying the earbud position. In some embodiments, an OFF position sensor is used, which is coupled to the I/O function 606.

Some of the embodiments described with reference to FIGS. 7-12 may be described as an apparatus comprising an earbud 305, 405 that is rotatably coupled to an earpiece and projects from a low front end of the earpiece 300, 400, wherein the earbud 305, 405 has at least two manually selectable rotational positions, namely a right ear position and a left ear position. The apparatus further comprises an electronics portion 325, 425 of the earpiece that comprises a housing 324, 424, a transceiver 615, and an antenna element 345, 445. The antenna element 345, 445 is electrically coupled to the transceiver. In response to a manual selection of the right ear position the antenna element is mechanically rotated to a right side 326, 426 of the housing, and, in response to a manual selection of the left ear position, the antenna element is mechanically rotated to a left side 327, 427 of the housing.

Some embodiments comprise a combination of the concepts described with reference to FIGS. 4-6 and FIGS. 7-11. These embodiments use the mechanical coupling of the rotational position from the earbud to the electronics portion described with reference to FIGS. 7-11 and use two antenna elements and an antenna switch within the electronics portion 225, as described with reference to FIGS. 4-6. In these embodiments, the mechanical position indicator (e.g., the rotating rod FIG. 8 335, FIG. 10 435) may terminate as a shaft for an electromechanical switch of the wafer type or other type. The electromechanical switch in these embodiments provides the functions of the electronic switch 640 shown in FIG. 6. In certain of these embodiments, there would be no need for a separate electrical position sensor such as the position sensor 230 shown in FIG. 6.

Figure 13:
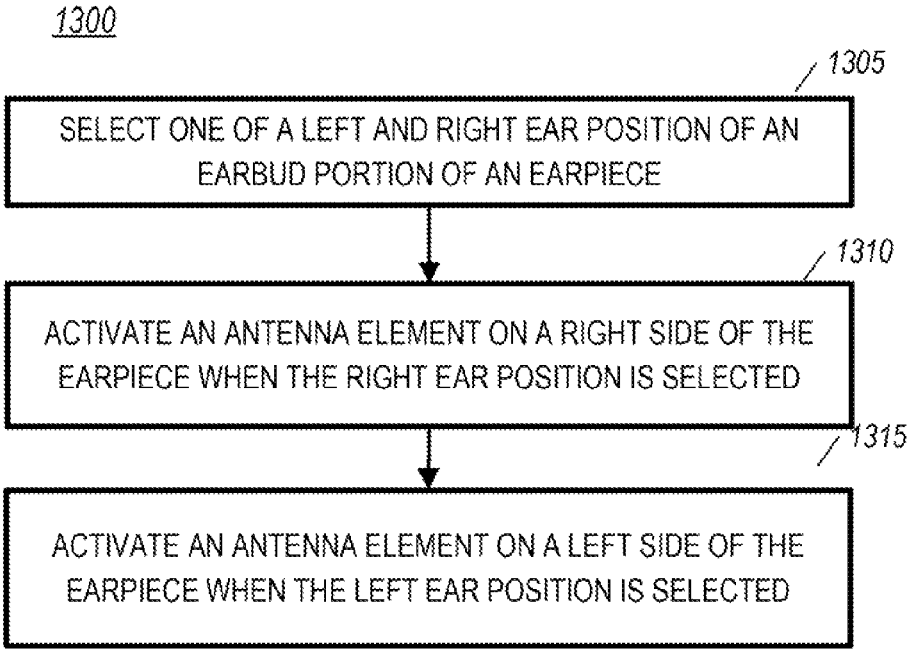
Referring to FIG. 13, a flow chart 1300 shows some method steps that are used in a wireless communication earpiece Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

Referring to FIG. 13 in conjunction with FIGS. 1-12 a flow chart 1300 (FIG. 13) shows some method steps that are used in a wireless communication earpiece, in accordance with certain embodiments. At step 1305 one of a left and right ear position of an earbud 205, 305, 405 of a wireless communication earpiece (a.k.a. an earpiece) is selected. This may be done manually. At step 1310, an antenna element on a right side of the earpiece is activated when the right ear position of the earbud is selected. This activation 1310 may comprise either electrically coupling a right antenna element to a transceiver (FIGS. 4-6) or mechanically rotating an electrically coupled antenna element to the right side of the earpiece (FIGS. 7-11). At step 1315 an antenna element on a left side of the wireless earpiece is activated when the left ear position of the earbud is selected. This activation 1315 may comprise either electrically coupling a left antenna element to a transceiver (FIGS. 4-6) or mechanically rotating an antenna element to the left side of the earpiece (FIGS. 7-11). In this context, activation does not necessarily correlate to continuous coupling of radio energy to or from the antenna element; in embodiments with an off mode, no energy may be coupled while in the off mode.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. An apparatus, comprising:

an earbud that is rotatably coupled to and projects from a low front end of an earpiece via a rotatable coupling between the earbud and the low front end of the earpiece, the earbud having manually selectable rotational positions, the manually selectable rotational positions being a right ear position and a left ear position;

a signal cable;

a rotational position sensing mechanism located at the rotatable coupling between the earbud and the low front end of the earpiece and configured for, upon manual selection of one of the two manually selectable rotational positions, sending information through the signal cable and to an electronics module, the information indicating when the earbud is in one of the two manually selectable rotational positions;

a housing;

a right antenna element disposed proximate a right outer side of the housing;

a left antenna element disposed proximate a left outer side of the housing; and the electronics module comprising one or more processing devices, a transceiver, and an electronic switch, the electronics module separate from the rotational position sensing mechanism and configured to receive, from the rotational position sensing mechanism and through the signal cable, the information indicating when the earbud is in one of the two manually selectable rotational positions, and to selectively couple the transceiver, based on the information, to the right antenna element or the left antenna element through the electronic switch.

2. The apparatus according to claim 1, the electronic switch performing a single pole double throw switching function.

3. The apparatus according to claim 1, the rotational position sensing mechanism comprising an electrical sensor.

4. The apparatus according to claim 1, wherein each of the right and left antenna elements is disposed on one of the inside surface and an outside surface of a wall of the housing.

5. The apparatus according to claim 1, wherein each of the right and left antenna elements is disposed proximate to and separate from an inside wall of elements the housing.

6. The apparatus according to claim 1, wherein the earbud projects at an angle of approximately 90 degrees with reference to a plane of a longitudinal axis of the earpiece.

7. The apparatus according to claim 1, wherein the earbud is projected from a boom of the earpiece and the earbud right and left ear positions are approximately plus and minus 90 degrees of the earbud projection with reference to a plane of a longitudinal axis of the earpiece.

8. The apparatus according to claim 1, wherein the manually selectable rotational positions of the earbud further comprise a power off position.

9. The apparatus according to claim 1, wherein the right and left antenna elements are used by the earpiece in at least one of the right and left ear positions in a multiple input multiple output configuration for at least one of transmission and reception.

10. The apparatus according to claim 1, wherein the right and left antenna elements are used by the earpiece in at least one of the right and left ear positions in diversity antenna configuration for reception.

11. The apparatus of claim 1, the rotational position sensing mechanism comprising:

a boom located beneath the rotatable coupling between the earbud and the low front end of the earpiece, the boom with conductive material disposed on an inside surface of the boom at the two manually selectable positions;

a conductive tab on a ring fixedly coupled to a crossover portion, the crossover portion located between the low front end of the earpiece and the housing and extending down within the boom, wherein the conductive tab sweeps the inside surface of the housing boom and is electrically grounded when one of the two manually selectable positions is selected, causing the signal cable to convey the manually selected position.

12. A method comprising:

manually selecting, through rotation of an earbud rotationally coupled to a low front end of a wireless earpiece, a left ear position or a right ear position of the earbud, the rotation causing a rotational position sensing mechanism located at a rotatable coupling between the earbud and the low front end of the wireless earpiece to send information indicating the manually selected position through a signal cable to an electronics module, the electronics module separate from the rotational position sensing mechanism and comprising one or more processing devices, a transceiver and an electronic switch; and responsive to receiving the information indicating the manually selected position and based on the information, selectively coupling, by the electronics module and through the electronic switch, the transceiver to the right antenna element or the left antenna element.

13. The method of claim 12, wherein receiving manual selection of one of a left and right ear position results in the earbud projecting approximately normal to a plane in which the remainder of the wireless earpiece lies.

14. The method of claim 12, wherein selectively coupling to the first antenna element causes the first antenna element to be used in a multiple input multiple output configuration for at least one of transmission and reception.

15. The method of claim 12, wherein selectively coupling to the second antenna element causes the second antenna element to be used in a multiple input multiple output configuration for at least one of transmission and reception.

16. The method of claim 12 further comprising:

manually selecting an off position, through rotation of the earbud rotationally coupled to the low front end of a wireless earpiece, causing the rotational position sensing mechanism to send through the signal cable and to the electronics module information indicating the earbud to be in the off position and where, upon receipt of the information by the electronics module, the wireless earpiece is turned off by the electronics module.

17. The method of claim 16, wherein receiving the manual selection of the off position causes selection of the off position, resulting in the earbud being approximately parallel with a plane in which the remainder of the wireless earpiece lies.

18. The method of claim 16, wherein receiving the manual selection of the off position causes selection of one of the left and right ear positions, resulting in the earbud projecting approximately normal to a plane in which the remainder of the wireless earpiece lies.

* * * * *